US006321397B1

(12) United States Patent
Fogg et al.

(10) Patent No.: US 6,321,397 B1
(45) Date of Patent: Nov. 27, 2001

(54) FLEXIBLE MOUNTING AND SEALING STRIPS

(76) Inventors: Manolo Fogg, 688 Preston St., Brick, NJ (US) 08723; Uzi Ovadia, 2579 Merrick Rd., Bellmore, NY (US) 11710

( * ) Notice: Subject to any disclaimer, the term of this patent is extended or adjusted under 35 U.S.C. 154(b) by 1 days.

(21) Appl. No.: 09/627,692

(22) Filed: Jul. 28, 2000

(51) Int. Cl.[7] ..... A47K 3/38
(52) U.S. Cl. ..... 4/609
(58) Field of Search ..... 4/558, 608, 609; 24/462

(56) References Cited

U.S. PATENT DOCUMENTS 4,231,141 * 11/1980 Derrick et al. ..... 24/462
4,594,741 * 6/1986 Payne ..... 4/608 X
4,771,517 * 9/1988 Bonanno ..... 4/609 X
4,887,324 * 12/1989 Cairns ..... 4/609

* cited by examiner

*Primary Examiner*—Charles E. Phillips
(74) *Attorney, Agent, or Firm*—Harris Beach LLP.

(57) ABSTRACT

This product is a flexible mounting and sealing method which combines the unique features of multiple sealing surfaces, a drainage passage directing moisture toward a containment area, and not requiring mechanical fasteners, in addition to being highly marketable. Additional features may include the angular clasping member to assist in the disengagement of the two attached members. The product has a high use range in both commercial and residential facilities, along with the mobile home and recreational vehicle market.

7 Claims, 3 Drawing Sheets

FLEXIBLE MOUNTING AND SEALING STRIPS

FIELD OF THE INVENTION

The present invention relates to mounting and sealing strips of PVC plastic or like compounds, one being male, the other being female, having an adhesive backing with a paper cover. This product may come in a semi-rigid or a flexible state that may be coiled for ease of shipping and storage. Such mounting and sealing strips interlock to form a water and weather tight pressure seal on two surfaces, yet may easily be disengaged, similar to a zip lock bag. This product also has the ability of being able to transport water down an internal drain channel and direct it into a containment area. More particularly, it relates to the sealing of the edge of a shower curtain, drape, shade, blind, portiere, storm window or the like, to an adjacent wall without using mechanical fasteners. A similarly attached disengagement means may be added to the product when used in the application of a shower curtain seal whereby, a third strip is added as an angled clasping member.

BACKGROUND OF THE INVENTION

This invention describes a new and unique multi-purpose household product with the simplicity and varied utilitarian aspects of hook-and-loop material Velcro®, the zipper or duct tape. In the field of attachments, hood-and-loop has been the state of the art for many years, with its major problems being, where moisture is involved. It tends to acquire molds and mildew, which cannot be easily cleaned therefor, producing odors. There is a need for creating an economical watertight seal on a shower curtain which includes channeling the water down and into the tub, especially in a rental establishment where putting permanent mechanical fasteners into a tile, fiberglass or marble wall would be prohibited. There is also a need for establishing a watertight seal on showers in RV's or mobile homes, where the walls are not structurally stable enough to facilitate mechanical fasteners. There again is a need for a weather sealing means to attach fabric or vinyl side rooms to RV's. These presently twist lock mechanical fasteners require the penetration of the side of the unit, creating a potential leak of moisture and a permanent hole, yet be easily disengaged for transport. And still another need is for a light, inexpensive attachment of vinyl coverings over windows and doors to retard damage by inclement weather. Another need is for an edge mounting material that has a primary and a secondary sealing means, with a channel air gap between to transport the trapped moisture therein down and out directed into a containment area. There is an unending need to securely attach curtains, drapes, blinds, portieres and the like to stop movement, without putting nails or screws into walls. In the area of home decorating and remodeling, there is a need for a great variety of simple economical fastening means. The convenience and economy of this flexible edge mounting and sealing product will allow it to be modestly priced, selling in wide variety of lengths, light and easily shipped, and thus creating an enormous market throughout the world.

U.S. Pat. No. 4,759,087 (Allan Zellinger) teaches of a complicated extruded device for shower curtains. It includes a wall attachment strip having a pre-applied adhesive back for adhering such strip to a vertical wall surface adjacent to the end edge of the shower curtain. A curtain attachment clip is adapted to be fastened to the end of the shower curtain in alignment with wall attachment strip. By folding a flap on one side of the curtain attachment clip over until a projecting rib portion on the flap moves into locking engagement in a channel on the curtain attachment clip, the curtain edge is disposed therebetween. This invention fulfills the requirement of not having mechanical fasteners but falls short of being a simple and multipurpose utility product as described herein. When the curtain attachment clip is inserted in the wall attachment strip in the fashion so described, there is no effective pressure sealing surfaces engaged. An adequate seal is maintained between the curtain and the curtain attachment clip but water can still escape between the curtain attachment clip and the wall attachment strip and out onto the floor.

U.S. Pat. No. 4,077,072 (Waldo Dezura) concentrates on a device for reasonably securing at least one end of a shower curtain to a bath tub compartment. This is also accomplished with adhesives, not using mechanical fasteners, but with a number of small parts specifically designed for shower curtains, not making a continuous seal throughout, and not having the added benefit of being useable for other applications.

U.S. Pat. No. 3,639,919 (Richard E. White) features a holder for a pair of bathroom shower curtains comprising of a single pair of flexible steal strips permanently adhered to a bathroom wall and extending downwardly from the adjacent shower curtain rod. A pair of corner blocks permits the strip to be bent and extended across the top of the tub. Each strip has a keyhole slot extending for its entire length. The outer edge of each curtain contains a cord that is pressed into the seal strip slot, to make a permanent water tight connection.

This permanent installation does not facilitate easy separation of the sealing unit, multiple seals, a drain mechanism, or function conveniently for any other purpose other than tub enclosures.

U. S. Pat. No. 2,049,061 (J. A. Hoegger) describes a guide member in which one edge of the shower curtain may be reasonably held, permitting easy removal of the same and yet effectively preventing the edge of the curtain from separating from the wall. This device is similar in the clasping aspect, but only having one primary sealing feature, with the channel member requiring a mechanical fastener into the wall. This material again has been designed as an effective shower bath curtain guard without the utilitarian aspects of being used in either shorter or longer lengths for any other purpose.

U.S. Pat. No. 2,303,502 (B. Rous) teaches of a complete draft proof shower curtain system with a special weighted skirt along the tub and a plurality of suction cups adapted to be pressed into engagement with the wall area. This system does not effect a continuous seal along the edge and is again designed for the specific use on showers only.

U.S. Pat. No. 5,606,752 (Shelton, Jr. et al.) discloses a splash guard apparatus for shower curtains that incorporates a spring loaded shower curtain clamping assembly that is reasonably affixed to the wall of a shower bath. With no rigid member in the edge of the shower curtain, it appears cumbersome to attach the curtain in place. Cleaning would be difficult due to the number of parts and springs.

U.S. Pat. No. 3,205,547 (N. B. Riekse) teaches of a device for attaching fabric or similar material to a support. This invention relates to a device for securing a sheet of fabric, plastic or other deformable material to a supporting surface so that the sheet material can be removed whenever desired. This material has a great similarity to the described product in that it incorporates two pieces. One piece is adhesively affixed to a wall surface, and the other piece loose, not easily stored unless engaged with the shower curtain. Though this material has been designed for purposes other than shower curtains, continued engagement and disengagement with the fabric, plastic or other deformable material within the pair of members therein described will produce a breaking down of the said fabric, and a limited life of the product.

U.S. Pat. No. 2,712,354 (J. C. Margolies) this invention describes a shower bath curtain device with the primary feature being a rigid member attached to the shower curtain with the attachment means being a single point on the wall. This device produces no continuous seal and is then limited to the use in a shower bath.

U.S. Pat. No. 5,070,551 (Harrison et al.) features a plurality of wall fasteners positioned along the vertical edge of a shower curtain reducing the likelihood of water escaping from the shower and onto the floor and surrounding area. This again, like the aforementioned prior art, lacks the complete sealing ability and is thus limited to shower bath use only.

Consequently, there exists a need for a mounting and sealing system that is economical to manufacture, light and easy to ship, and has a myriad of uses. A further need is for an interlocking system that can be engaged and disengaged an interminable number of times, without damage to the fabric involved. And there again is an additional need for a system with a dual seal and a drain passage between to transport moisture therein without jeopardizing the said sealing means.

SUMMARY OF THE INVENTION

This present invention accomplishes its desired objectives by providing the simplest, yet most effective means of a mounting and sealing system available. This system is comprised of two ductile formed plastic members, the first being a channel-encapsulating member, and the second being the grooved attachment member, both having foam adhesive with a paper peel off surface on the back side. Both members may be of a clear material or colored to match different decors. The channel-encapsulating member will be reasonably adhered to a wall by removing the paper peel-off backing and applying the adhesive surface against the wall thereby providing an adhesive means of attachment of the device to the wall and in a similar fashion to the curtain to be secured. Other mechanical fastening means of attachment of the device to the wall or curtain such as nails or screws may be required when the product is used in other applications, still leaving enough area within to effectively work as a drain channel. The channel member has two diametrically opposing inward protrusions at the outer most sides forming a "C" channel, which encapsulates the grooves in the adjoining attachment member when properly aligned and pressed firmly together. The groove attachment member will be similarly adhered to the hem or sides of the fabric with which the enclosure is made by the means of removing the paper peel-off surface and pressing into place. Two "U" shaped grooves extend outwardly in opposite directions from the attachment member, entrapping the two diametrically opposed protrusions on the channel member, thus forming two opposing pressure seals on the sides and creating a means of drainage therein in the form of the channel formed between the attachment member and the channel member when engaged. With the grooved attachment member slightly shorter than the channel-encapsulating member that is attached to the wall, moisture therein will drain out into the containment area through the opening. An optional orifice on the side of the channel-encapsulating member at the lower end will direct the moisture therein toward the containment area. When engaging or disengaging the two parts, a limited resistance is incurred until the action is initiated and the coefficient of friction allows them to translate easily. While a suitable arrangement exists with the two components, using an angular clasping member with similar adhesive attachment to the opposite side of the hem from the groove attachment member, an added means of disengagement created. The adhesion of these three parts will be improved with holes being punched with a standard hole punch, allowing the two adhesive surfaces to consolidate. The current best mode would have these components manufactured by the extrusion of a flexible polymer, though other manufacturing methods may be developed. In some instances, substantially rigid components of the same configuration, and for the same application, may be required.

The object of this invention is to produce a simple product that efficiently retains moisture in a dual sealing method and directs it down a drain passage and out into a containment area as in a bathtub or shower.

Another object of this invention is to provide a product that can be used effectively in many areas of the recreation vehicle and mobile home industry where wall structures are light, containment of moisture is essential, and plastic fasteners are used in great numbers.

Another object of this invention is the creation of a product that can effectively be used for the attachment of weather sealing fabric rooms on the sides of recreation vehicles.

Another object of this invention is to provide a product that can be used on the installation of vinyl covering over windows and doors in cold climates to retard damage by inclement weather.

Another object of this invention is to produce a product with the said characteristics that can be flexible enough to be rolled into coils and sold in random lengths cut to order, or may also be sold in precut lengths of semi-rigid stock.

Still another object of this invention is to create a product that does not retain moisture, does not collect lint and fuzz, is easy to clean and still offers a similar engagement and disengagement capability as Velcro.

BRIEF DESCRIPTION OF DRAWING FIGURES

DETAILED DESCRIPTION OF PREFERRED EMBODIMENTS

Figure 1:
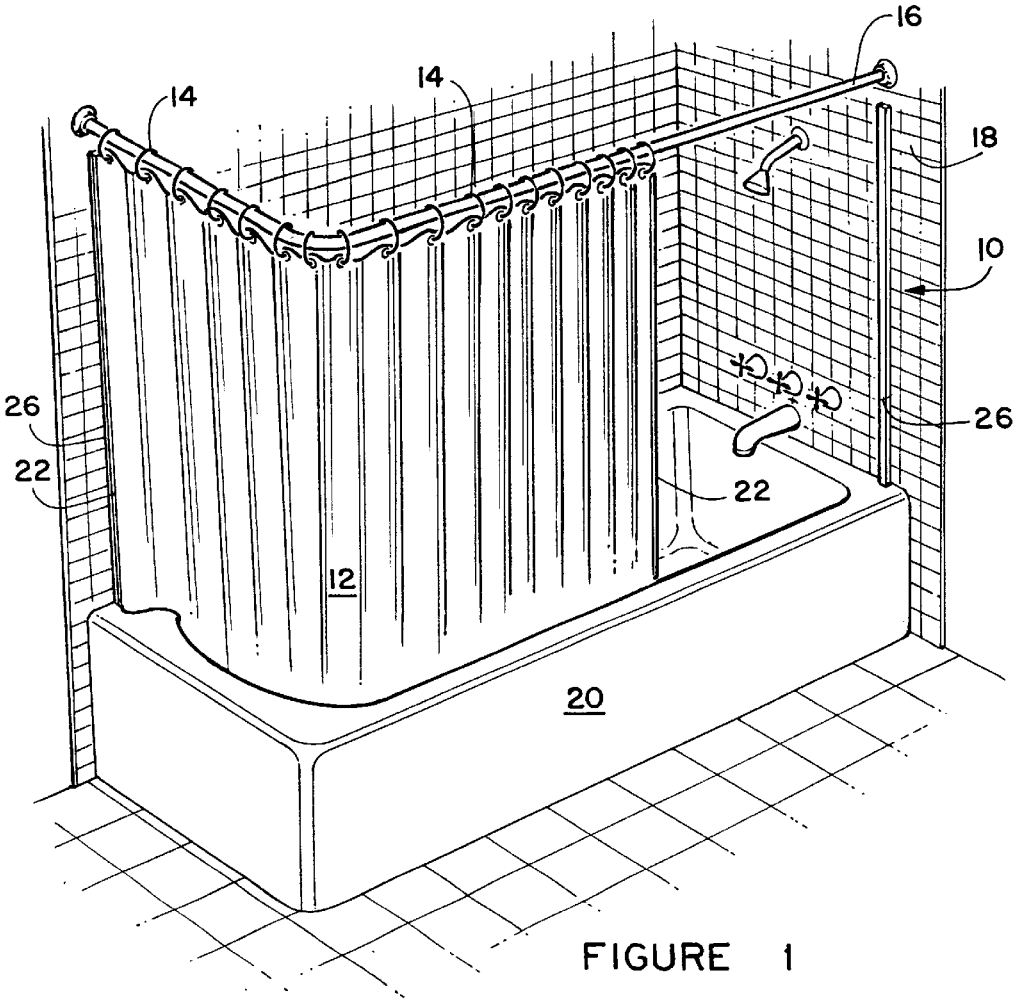
FIG. 1 is a perspective of a tub and shower enclosure with the flexible mounting and sealing strips installed on both ends of the shower curtain and attached to the walls.
Figure 2:
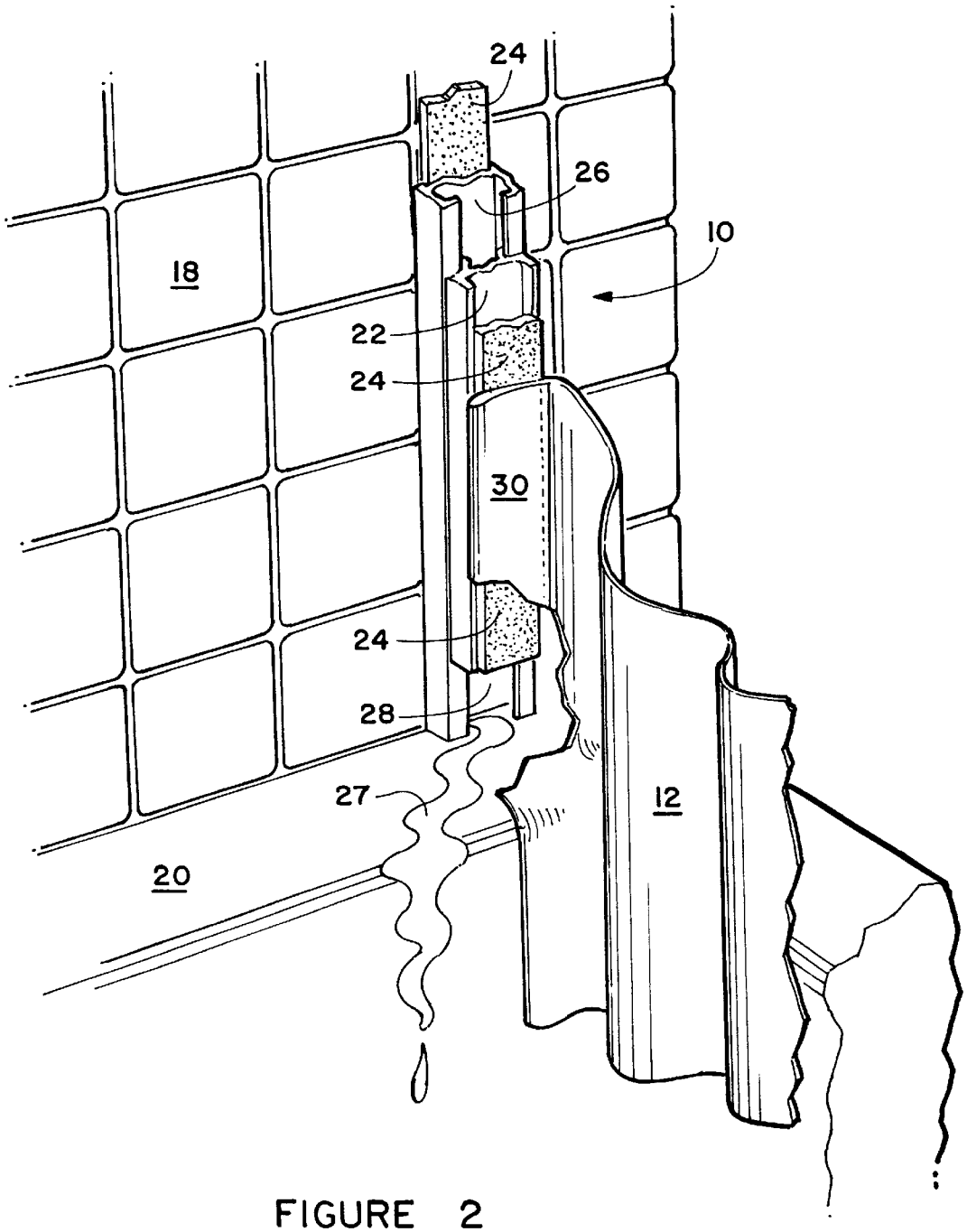
FIG. 2 is a perspective view of a shower curtain installation assembly in the engaged position.

Referring now to the drawings, specifically FIG. 1 and 2 depict a preferred embodiment of the device 10 as a resilient mounting and sealing strip shown in the embodiment of a shower curtain seal where it provides a major improvement over conventional shower curtain mounting which generally leaks through gaps. However other curtains and flexible walls needing sealed edges could use the device 10 and such applications are foreseen.

The shower curtain 12 is held in place in a conventional fashion above the tub 20 by a set of rings 14 to curtain rod 16 encompassing the periphery of the enclosure that is thereupon attached to the wall 18. The shower curtain 12 falls naturally into the confines of the tub 20, but hangs loosely at the edges allowing the user to grip the curtain for pulling and disengagement of the two parts to the device 10 when engaged. This disengagement to a separate position provides a user variable gap between the two halves of the device when in a separate position thereby providing the user a means for entry into and exit from the tub 20 when the attachment member 22 is disengaged from the channel encapsulating member 26.

Figure 5:
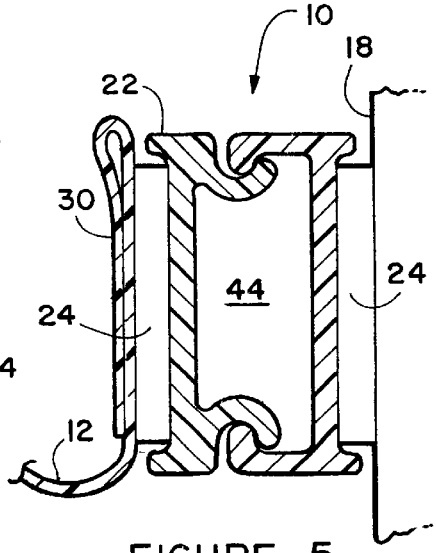
FIG. 5 is an end view of a shower curtain assembly with grooved engagement member and the channel-encapsulating member in the engaged position.

A sealed engagement of the curtain 12 with the wall 18 is provided by the joining of the flexible and resilient grooved attachment member 22, with the resilient channel-encapsulating member 26, shown in FIG. 2 in an engaged position and also depicted in the end view in FIG. 5. When cooperatively attached in an engaged position the attachment member 22 and channel encapsulating member 26 form a pair of substantially water tight seals thereby stopping water from leaking between the curtain hem 30 and wall 18 as would be the case in conventional shower curtain mountings upon tube 20.

Figure 3:
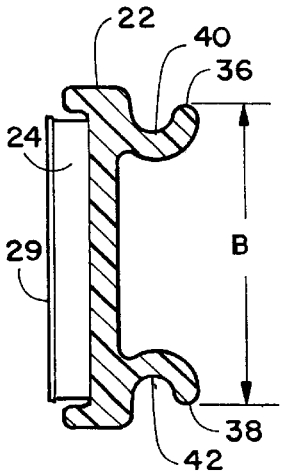
FIG. 3 is an end view of the resilient grooved engagement member.
Figure 4:
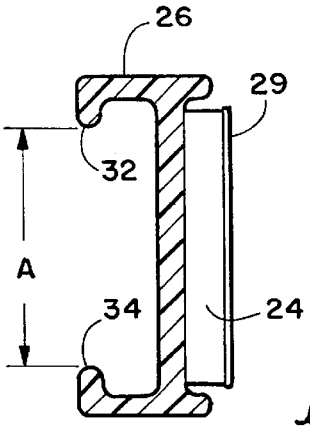
FIG. 4 is an end view of the resilient channel-encapsulating member.

The flexible grooved attachment member shown in FIG. 3, is best attached to the hem 30 of the shower curtain 12 using an adhesive means of attachment in the form of a peel and stick adhesive backing 24 attached to the substantially flat mounting side of the attachment member 22 by removing the paper peel-off protective surface 29 and pressing firmly against the edge of the curtain 12. The channel-encapsulating member 26 shown in FIG. 4 is similarly configured with an adhesive backing 24 affixed to an attachment side with a peel-off paper protective surface 29 which is removed for mounting and attaches to the intended wall 18 at one or both vertical edges of the sliding curtain 12.

The union between the channel-encapsulating member 26 and the attachment member 22 is accomplished by a cooperative engagement between the two diametrically opposing "L" shaped inward protrusions 32 and 34 attached to the mating side opposite the attachment side of the channel-encapsulating member 26 and the "U" shaped grooves 40 and 42 formed by the wall surface of outwardly protruding tips 36 and 38 which protrude from the engagement side opposite the mounting side of the attachment member 22. The resilient material forming the grooved attachment member 22 allows the protruding tips 36 and 38 to flex inward of the L shaped inward protrusions 32 and 34 of the channel-encapsulating member 26 during insertion to the engaged position and bias away from each other toward and outward direction. The resilient nature of the material forming the L shaped protrusions also biases them toward the protruding tips providing an especially stable engagement. This creates a biased engagement of both tips 36 and 38 with both protrusions 32 and 34 and a double sealing means or sealing means with two parallel seals to prevent water from leaking past the device 10.

The device 10 when in the engaged position shown in FIG. 5, showing the sealing means and aforementioned two seals, creates a means of sealing both edges of the assembly while concurrently forming a means for directional draining of water breaching the first seal, in the form of drain passage 44 therein. This drain passage 44 insures that any errant moisture passing through the first seal on the tub side of the device 10 will be stopped by the second seal and will therein flow down the drain passage 44 and be directed into the tub. The means for directional drainage in the current best mode is provided by one or a combination of drain aperture 50, shown in FIG. 6, which communicates with the drain passage 44 on the tub side wall surface of the channel member 26 or, slot aperture 28 of FIG. 2, formed by the grooved attachment member 22 being dimensioned slightly shorter than the length of the channel member 26 thereby creating the slot aperture 28. Due to the natural tub side slant of the tub surface, any water 52 breaching the first sealing edge on the tub side and caught by the drain passage 44 exits toward the tub 20 through one or both of the slot aperture 28 and the drain aperture 50 which communicate with the drain passage 44. This prevents water 52 from falling on the floor outside the tub 20 where it could cause damage or injury.

Figure 6:
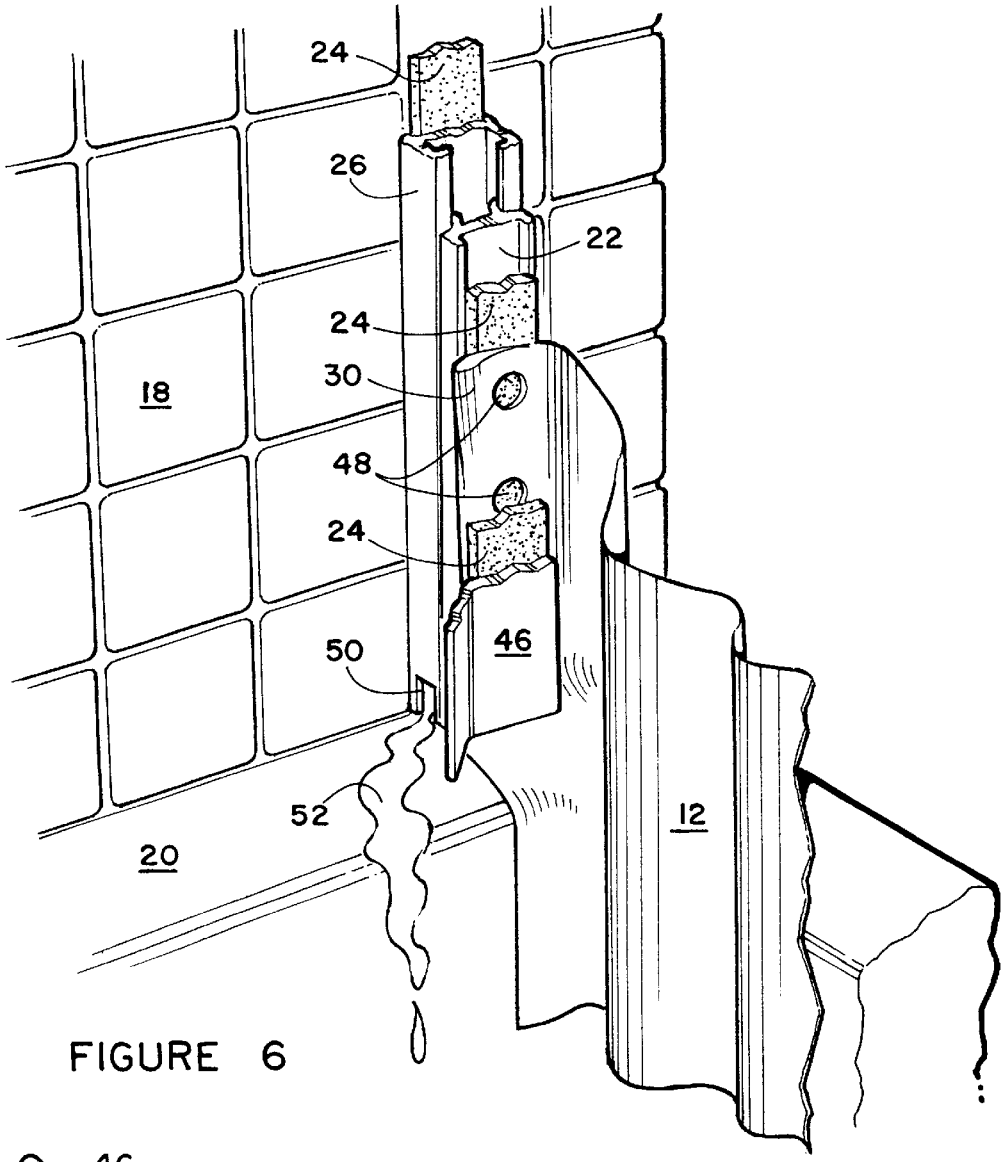
FIG. 6 is a perspective view of a shower curtain installation assembly with an optional angular clasping member, and depicting water being directed back into the tub.
Figure 7:
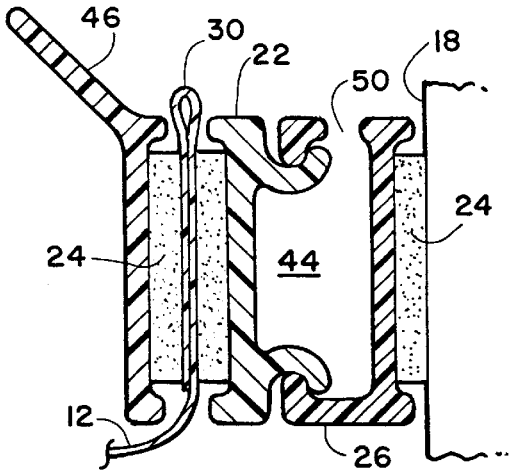
FIG. 7 is the end view of said assembly showing the engagement member having an optional angular clasping member and showing the side orifice at the bottom.

FIG. 6 further describes an alternate embodiment whereby the channel-encapsulating member 26 and the grooved attachment member 22 incorporate an angular clasping member 46 adhered to the hem 30 shown in FIG. 7, and may run from top to bottom, or may be used in short segments as required. The angular clasping member 46 could also be formed as part of the grooved attachment member 22. If extra strength of a mount is desired for high use conditions, the gripping means attachment to the hem 30 can be established by punching holes 48, whereby the adhesive on the common foam adhesive backings 24 may consolidate.

Figure 8:
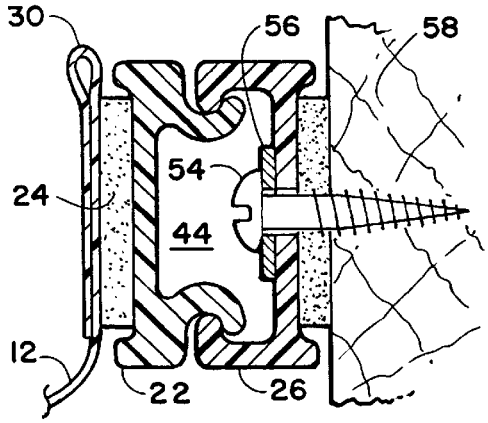
FIG. 8 is an end view of the assembly depicting a means of attachment in the form of screw and washer attaching the channel-encapsulating member to a wall or window.

FIG. 8 elaborates on the mechanical means of attachment for channel member 26 should a very strong attachment to the wall be desired and includes the incorporation of a screw 54 and washer 56, whereby the assembly may be attached to a mounting surface 58 such as wood framing in houses and when used in many of the alternative concepts requiring other than an adhesive mount.

While all the fundamental characteristics and features of the flexible mounting and sealing strips have been shown and described, it should be understood that various substitutions, modifications, and variations may be made by those skilled in the art without departing from the spirit or scope of the invention. Consequently, all such modifications and variations are included within the scope of the invention as defined by the following claims.

What is claimed is:

1. A sealing strip for use in combination with a flexible curtain comprising:

an elongated channel member formed of resilient material, said channel member having and attachment side and a mating side opposite said attachment side;

an elongated attachment member; said attachment member having a mounting side and an engagement side, said attachment member cooperatively engageable with said elongated channel member;

a pair of elongated resilient protruding tips attached to said engagement side of said attachment member, said protruding tips each curving away from each other from their attachment on one end to said engagement side of said attachment member;

a pair of elongated inward protrusions affixed to said mating side of said channel member, said inward protrusions attached to said channel member at a first end and curving toward each other at their distal ends;

an elongated slot formed between said distal ends of said pair of elongated inward protrusions;

a first water sealing means and a second water sealing means both formed when said elongated channel member is cooperatively engaged with said elongated attachment member;

means of attachment of said elongated channel member to a wall surface;

means of attachment of said attachment member to the edge of a hanging curtain; and whereby said edge of said hanging curtain may be placed in sealed communication with said wall surface when said elongated channel member is placed in cooperative engagement with said elongated attachment member.

2. The sealing strip as defined in claim 1, additionally comprising:

a drain passage, said drain passage defined by said attachment side of said channel member, said mounting side of said attachment member, and the elongated walls formed by cooperative engagement between said pair of protrusions with said pair of protruding tips, said drain passage running the length of said elongated channel member and communicating any water trapped therein during use, to side of said curtain adjacent to the interior of said tub.

3. The sealing strip as defined in claim 2, additionally comprising a drain aperture communicating through said elongated channel member with said drain channel.

4. The sealing strip as defined in claim 2, additionally comprising a slot aperture adjacent to the tub end of said channel member, said slot aperture providing communication to said drain channel, said slot aperture formed by cooperative engagement of an attachment member which is shorter than the channel member with which it is cooperatively engaged.

5. The sealing strip as defined in claim 1, additionally comprising said first water sealing means is comprised of cooperative engagement between one of said pair of protruding tips and one of said pair of protrusions and said second water sealing means is formed by cooperative engagement between the second of said pair of protruding tips and the second of said pair of protrusions.

6. The sealing strip as defined in claim 5, wherein said pair of protruding tips and said pair of protrusions are biased toward each other when in cooperative engagement.

7. The sealing strip as defined in claim 1, additionally comprising an angular clasping member extending from an attachment with said attachment member.

* * * * *